US006155440A

United States Patent [19]

Arce

[11] Patent Number: 6,155,440

[45] Date of Patent: Dec. 5, 2000

[54] CEILING-MOUNTED STORAGE BRACKET

[76] Inventor: James J. Arce, 177 London Dr., Palm Coast, Fla. 32137

[21] Appl. No.: 09/344,011

[22] Filed: Jun. 25, 1999

[51] Int. Cl.[7] ..... A47F 5/08

[52] U.S. Cl. ..... 211/118

[58] Field of Search ..... 211/118, 113, 211/117, 60.1

[56] References Cited

U.S. PATENT DOCUMENTS

| | | |
|---|---|---|
| 602,099 | 4/1898 | Palmer . |
| 1,566,551 | 12/1925 | Ghrand . |
| 2,486,035 | 10/1949 | Koester . |
| 3,556,320 | 1/1971 | Henderson . |
| 3,885,675 | 5/1975 | Hultenby et al. . |
| 4,325,486 | 4/1982 | Neal . |
| 5,649,751 | 7/1997 | Longhurst . |
| 5,725,293 | 3/1998 | Wilkening et al. . |
| 5,769,181 | 6/1998 | Gussow et al. . |
| 5,788,349 | 8/1998 | DeMaine et al. . |
| 5,794,793 | 8/1998 | Frederick . |
| 5,806,691 | 9/1998 | Nelson . |
| 5,819,873 | 10/1998 | Higgins . |
| 5,848,708 | 12/1998 | Edwards . |

*Primary Examiner*—Alvin Chin-Shue
*Assistant Examiner*—Sarah Purol
*Attorney, Agent, or Firm*—Paul S. Rooy

[57] ABSTRACT

A ceiling-mounted storage bracket having a top member rigidly attached to a pair of side members, and a bottom member rigidly attached to the side members. The top member, side members and bottom members define a storage aperture sized to admit items to be stored. Alternate embodiments of the ceiling-mounted storage bracket are disclosed which provide two mutually cooperating top members, which may be translated relative to each other so as to vary the width of the storage aperture. An alternate embodiment is disclosed wherein the ceiling-mounted storage bracket is made of bolted-together angle iron, and a bottom member attached to the side member by means of brackets, to permit both the height and the width of the storage aperture to be varied. The ceiling-mounted storage brackets are generally used in pairs, so that each ceiling-mounted storage bracket may support one extreme of an article(s) to be stored.

6 Claims, 3 Drawing Sheets

CEILING-MOUNTED STORAGE BRACKET

BACKGROUND OF THE INVENTION

1. Field of the Invention

This invention relates to storage brackets, and in particular to a ceiling-mounted storage bracket.

2. Background of the Invention

During this century the automobile has become the pre-eminent means of transportation in the United States. Accordingly, many single-family residences now include a garage within which to house the family automobile.

Modern garages tend to fulfill a variety of functions: besides housing a car, they may also accommodate a clothes washing machine and dryer, a hot water heater, and also serve as a storage building. In view of the many roles garages are expected to play, it is not surprising that storage space in a garage may become limited, especially for long thin articles such as pipes and ladders.

Existing Designs

One answer to the problem of garage storage scarcity has been the design of overhead storage bins and wall- or ceiling-mounted brackets capable of storing long, thin items. For example, DeMaine et al. were granted U.S. Pat. No. 5,788,349 for an Overhead Storage System with Illuminated Signage. While this design provided increased storage space, it was also complex and consequently expensive.

Gussow et al. were granted U.S. Pat. No. 5,769,181 for a Ladder Bracket and Staging Utilizing the Same. While this bracket system was capable of holding two ladders upright, the Gussow et al. patent did not teach ladder storage.

U.S. Pat. No. 5,819,873 was granted Higgins for a Ladder Bracket and Lock. The Higgins patent taught a wall-mounted bracket with a rotatable end plate which could swivel out of the way long enough for a ladder leg to be placed in the bracket, and then the end plate could be rotated back into a locked position, thereby holding the ladder within the bracket. While Higgins '873 provided a ladder storage system, it was complex and included moving parts, and therefore was expensive.

SUMMARY OF THE INVENTION

Accordingly, it is an object of the present invention to provide a ceiling-mounted storage bracket which is quickly and easily installed. Design features allowing this object to be accomplished include a top member having top member bores sized to accommodate a screw or other standard fastener, which can be inserted through the top member bore and screwed into a ceiling. Advantages associated with the accomplishment of this object include ease of installation and the associated cost saving.

It is another object of the present invention to provide a ceiling-mounted storage bracket which accommodates a wide variety of long, narrow items for storage. Design features allowing this object to be accomplished include a top member and bottom member rigidly attached to side members, and a storage aperture defined by the top, bottom and side members. Benefits associated with the accomplishment of this object include the ability to store long and narrow items off the floor, immediately below the ceiling, or in the alternative, on a wall, thus increasing usable floor space.

It is still another object of this invention to provide a ceiling-mounted storage bracket which is adjustable in width. Design features enabling the accomplishment of this object include, in a first alternate embodiment ceiling-mounted storage bracket, a first top member angle iron nested in a second top member angle iron, secured in place with screws. In a second alternate embodiment ceiling-mounted storage bracket, design features enabling the accomplishment of this object include a female top member having a female top member aperture sized to slidably accommodate a male top member. An advantage associated with the realization of this object is increased flexibility of use of the ceiling-mounted storage bracket, and the possibility of expanding and reducing its width as necessity and convenience dictate.

It is yet another object of this invention to provide a ceiling-mounted storage bracket which is adjustable in height. Design features enabling the accomplishment of this object include, in a first alternate embodiment ceiling-mounted storage bracket, a bottom member mounted to side member angle irons by means of bottom member brackets. The bottom member brackets are removably mounted to the side member angle irons by means of bottom member bracket screws. An advantage associated with the realization of this object is increased flexibility of use of the ceiling-mounted storage bracket, and the possibility of expanding and reducing its height as necessity and convenience dictate.

It is yet another object of this invention to provide a ceiling-mounted storage bracket made of inexpensive materials. Design features allowing this object to be achieved include the use of components made of readily available materials and off-the-shelf fasteners. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIGS. 1 and 2. Sheet two contains FIG. 3. Sheet three contains FIG. 4.

DETAILED DESCRIPTION OF THE PREFERRED EMBODIMENT

Figure 1:
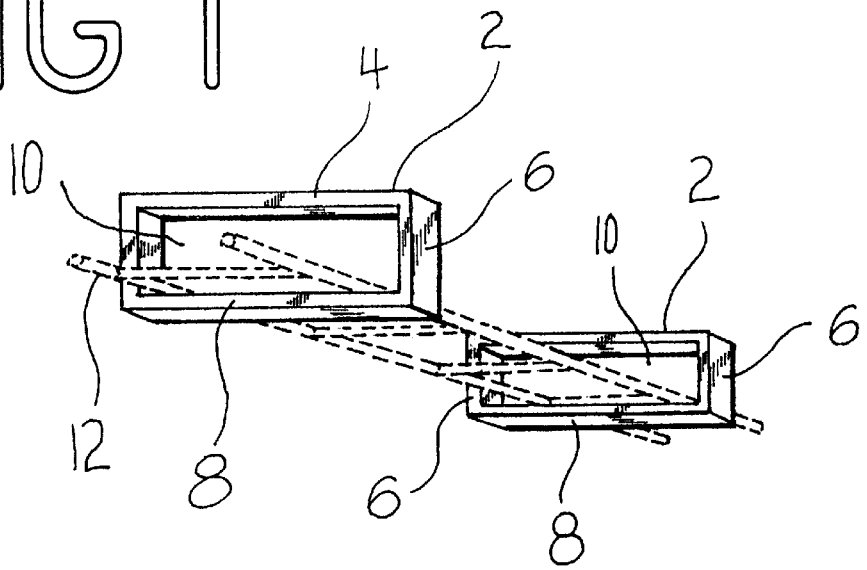
FIG. 1 is a front isometric view of a pair of ceiling-mounted storage brackets with a ladder stored in them.

FIG. 1 is a front isometric view of a pair of ceiling-mounted storage brackets 2 with ladder 12 stored in them. Each ceiling-mounted storage bracket 2 comprises top member 4 rigidly attached to an upper extreme of a pair of side members 6, and bottom member 8 rigidly attached to a lower extreme of the pair of side members 6. Top member 4, side members 6 and bottom member 8 define storage aperture 10. Storage aperture 10 is sized to accommodate long and narrow items such as ladders, pipes, etc.

Figure 2:
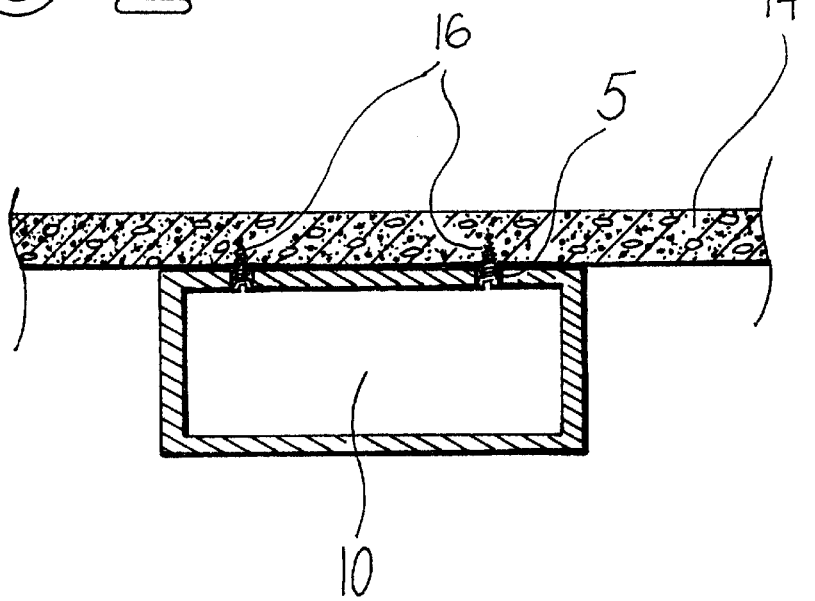
FIG. 2 is a front cross-sectional view of a ceiling-mounted storage bracket mounted on a ceiling.

Referring now also to FIG. 2, we observe a front cross-sectional view of ceiling-mounted storage bracket 2 mounted to ceiling 14. Top member 4 comprises a plurality of top member bores 5, sized to accommodate screws 16.

Ceiling-mounted storage bracket 2 is installed on ceiling 14 by inserting screws 16 through top member bores 5, and screwing screws 16 into ceiling 14.

In use, generally a pair of ceiling-mounted storage brackets 2 is used to store long, narrow objects. However, any number may be used as required to store the objects in question. Although in the preferred embodiment ceiling-mounted storage bracket 2 was mounted to a ceiling of a garage or storage building, it is contemplated that ceiling-mounted storage brackets 2 may be mounted to a wall, or any other convenient surface, and that ceiling-mounted storage brackets 2 may be used in any suitable environment, including in residences, stores, warehouses, etc., not only in garages and storage buildings.

In the preferred embodiment, ceiling-mounted storage bracket 2 was manufactured of wood or other suitable material. Off-the-shelf fasteners such as wood screws and nails were used in its assembly and installation on a suitable surface.

Figure 3:
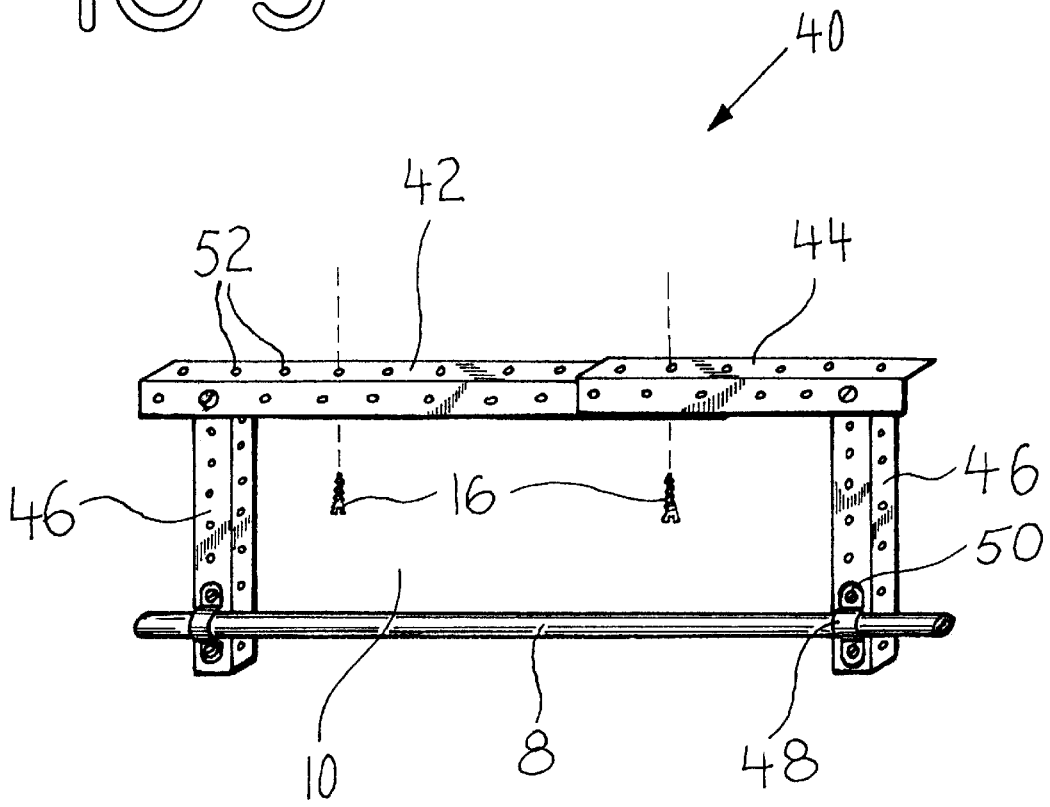
FIG. 3 is a front isometric view of a first alternate embodiment ceiling-mounted storage bracket.

FIG. 3 is a front isometric view of first alternate embodiment ceiling-mounted storage bracket 40. First alternate embodiment ceiling-mounted storage bracket 40 comprises first top member angle iron 42 partially nested in second top member angle iron 44, and a side member angle iron 46 attached to each top member angle iron 42 and 44.

All angle iron members consist of a sheet of metal or other appropriate material bent longitudinally at substantially a ninety degree angle, thus forming two legs when the angle iron is viewed from one extreme. Each leg comprises a plurality of longitudinally arranged angle iron bores 52. This basic structure of angle iron is well-known in the art, and is readily available commercially as an off-the-shelf structural member.

Each extreme of bottom member 8 is attached to a lower extreme of a side member angle iron 46 by means of a bottom member bracket 48. Bottom member brackets 48 are attached to side member angle irons 46 by means of bottom member bracket bolt(s) 50. Two bottom member bracket 48 embodiments contemplated to be within the scope of the instant invention are a single screw bottom member bracket 48, and the two-screw bottom member bracket 48 which is pictured in FIG. 3.

The width of first alternate embodiment ceiling-mounted storage bracket 40 may be increased or decreased by sliding first top member angle iron 42 relative to second top member angle iron 44. First top member angle iron 42 and second top member angle iron 44 are mounted to a ceiling, wall, or other suitable surface by means of screws 16 through angle iron bores 52. If desired, first top member angle iron 42 and second top member angle iron 44 may be aligned so the angle iron bores 52 within their mutually nested lengths are co-extensive, in which case a screw 16 may be inserted through both an angle iron bore 52 of first top member angle iron 42, and then through an angle iron bore 52 of second top member angle iron 44, and then screwed into a mounting surface. In this fashion a single screw 16 may perform the dual functions of fixing the width of first alternate embodiment ceiling-mounted storage bracket 40, and securing same to a suitable mounting surface.

The height of first alternate embodiment ceiling-mounted storage bracket 40 may be increased or decreased by altering the specific angle iron bores 52 of side member angle irons 46 to which bottom member brackets 48 are attached. For example, the height of storage aperture 10 may be decreased by simply detaching bottom member brackets 48 from their respective side member angle irons 46, moving them up a few angle iron bores 52, and then re-attaching the bottom member brackets 48 to their respective side member angle irons 46 by means of bottom member bracket bolts 50 though angle iron bores 52.

Figure 4:
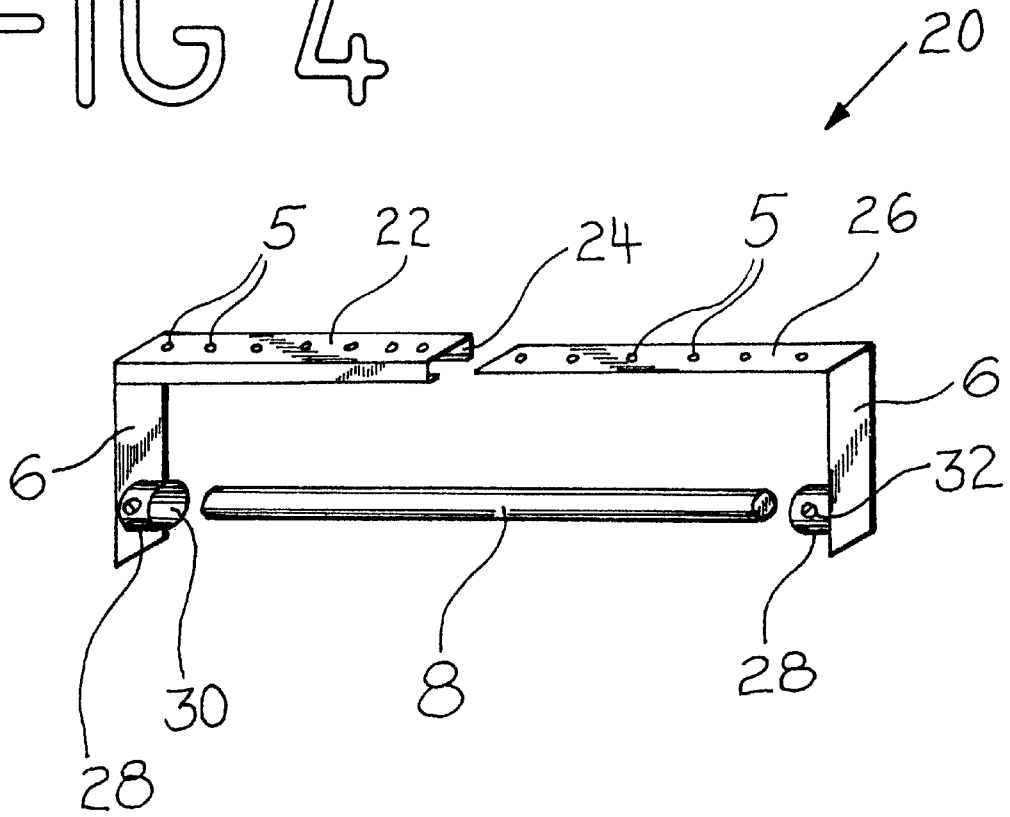
FIG. 4 is a front isometric view of a second alternate embodiment ceiling-mounted storage bracket.

FIG. 4 is a front isometric view of second alternate embodiment ceiling-mounted storage bracket 20. Second alternate embodiment ceiling-mounted storage bracket 20 comprises a female top member 22 having a female top member aperture 24 sized to slidably accommodate a male top member 26. One side member 6 is attached to an extreme of male top member 26, and one side member 6 is attached to an extreme of female top member 22. A bottom member receptacle 28 having a bottom member receptacle aperture 30 and set screw 32 is attached to each side member 6. Bottom member receptacle aperture 30 is sized to admit an extreme of bottom member 8.

During installation, first the width of second alternate embodiment ceiling-mounted storage bracket 20 is determined by sliding male top member 26 into female top member 22 until the desired width is obtained. Bottom member 8 is cut to the appropriate length, and then one bottom member receptacle 28 is slid over each extreme of bottom member 8 and set screws 32 tightened. The installation is completed by inserting screws or other appropriate fasteners through top member bores 5 and into a ceiling, wall, or other appropriate mounting surface.

In the second preferred embodiment of ceiling-mounted storage bracket 20, bottom member receptacles 28 and bottom member 8 were commercially available components. Bottom member receptacles 28, for instance, might be electrical conduit components.

While a preferred embodiment of the invention has been illustrated herein, it is to be understood that changes and variations may be made by those skilled in the art without departing from the spirit of the appending claims.

DRAWING ITEM INDEX

2 ceiling-mounted storage bracket
4 top member
5 top member bore
6 side member
8 bottom member
10 storage aperture
12 ladder
14 ceiling
16 screw
20 second alternate embodiment ceiling-mounted storage bracket
22 female top member
24 female top member aperture
26 male top member
28 bottom member receptacle
30 bottom member receptacle aperture
32 set screw
40 first alternate embodiment ceiling-mounted storage bracket
42 first top member angle iron
44 second top member angle iron
46 side member angle iron
48 bottom member bracket
50 bottom member bracket bolt
52 angle iron bore.

I claim:

1. A ceiling-mounted storage bracket comprising a top member, a side member rigidly attached to each extreme of said top member, and a bottom member rigidly attached to extremes of said side members opposite said top member, said top member, side members, and bottom member defining a storage aperture, said top member comprising a plurality of top member bores sized to admit screws, whereby said ceiling-mounted storage bracket may be installed on a mounting surface such as a wall or ceiling.

2. A ceiling-mounted storage bracket comprising two mutually cooperating top members, a side member attached to each said top member, and a bottom member attached to said side members, said top members, side members, and bottom member defining a storage aperture, said two top members consisting of a first top member angle iron and a second top member angle iron, said first top member angle iron being sized to nest within said second top member angle iron, said side members being side member angle irons, each of the angle iron members being "L" shaped in cross-section, each leg of said "L" comprising a plurality of angle iron bores, whereby said ceiling-mounted storage bracket may be mounted to a suitable mounting surface by means of screws through iron angle bores in said first top member angle iron and said second top member angle iron, whereby a width of said storage aperture may be varied to suit the requirements of the application.

3. The ceiling-mounted storage bracket of claim 2 wherein said ceiling-mounted storage bracket is mounted to a suitable mounting surface by means of screws through iron angle bores in said first top member angle iron and said second top member angle iron, whereby a width of said storage aperture may be varied to suit the requirements of the application.

4. The ceiling-mounted storage bracket of claim 3 wherein said bottom member is rigidly attached to said side member angle irons by means of bottom member brackets, said bottom member brackets being attached to said side member angle irons by means of bottom member bracket bolts, whereby a height of said storage aperture may be varied to suit the requirements of the application.

5. The ceiling-mounted storage bracket of claim 4 wherein said side member angle irons are rigidly attached to said first top member angle iron and to said second top member angle iron by means of nuts and bolts through appropriate angle iron bores in said first top member angle iron, said second top member angle iron, and in said side member angle irons.

6. At least two ceiling-mounted storage brackets, each said storage bracket comprising a top member, a side member rigidly attached to each extreme of said top member, and a bottom member rigidly attached to extremes of said side members opposite said top member, said top member, side members, and bottom member defining a storage aperture, each said top member comprising comprises a plurality of top member bores sized to admit screws, whereby said ceiling-mounted storage brackets may be installed on a mounting surface such as a wall or ceiling.

* * * * *